US005536433A

United States Patent [19]

De Gaye

[11] Patent Number: 5,536,433

[45] Date of Patent: Jul. 16, 1996

[54] CAKE OF SOAP

[76] Inventor: Emmanuel J. De Gaye, 48 Jambanis Road, Wanneroo Western Australia 6065, Australia

[21] Appl. No.: 211,062

[22] PCT Filed: Sep. 18, 1992

[86] PCT No.: PCT/AU92/00497

§ 371 Date: May 23, 1994

§ 102(e) Date: May 23, 1994

[87] PCT Pub. No.: WO93/06206

PCT Pub. Date: Apr. 1, 1993

[30] Foreign Application Priority Data

Sep. 20, 1991 [AU] Australia ..... PK8463

[51] Int. Cl.[6] ..... C11D 17/00

[52] U.S. Cl. ..... 510/449; 510/146; 510/148

[58] Field of Search ..... 252/91, 92, 134, 252/174, DIG. 16

[56] References Cited

U.S. PATENT DOCUMENTS

| | | | |
|---|---|---|---|
| 692,481 | 2/1902 | Robinson | 252/90 |
| 3,931,035 | 1/1976 | Brown | 252/134 |
| 4,318,878 | 3/1982 | Hörning | 264/148 |

FOREIGN PATENT DOCUMENTS

| | | | |
|---|---|---|---|
| 3934094 | 5/1991 | Germany | 252/90 |

*Primary Examiner*—Asok Pal
*Assistant Examiner*—Patricia L. Hailey
*Attorney, Agent, or Firm*—Merchant, Gould, Smith, Edell, Welter & Schmidt

[57] ABSTRACT

A cake of soap (10) provided with a cavity (12) for receiving a remnant of soap, the cavity (12) extends into the interior region of the cake of soap (10).

24 Claims, 2 Drawing Sheets

CAKE OF SOAP

This invention relates to a cake of soap.

More specifically the invention relates to a cake of soap which is adapted to receive a remnant of a used cake of soap.

A cake of soap is usually used until it reaches a stage where is becomes difficult to hold and thereafter the user will more often than not simply throw the remaining piece of soap away. Typically this discarded remnant of soap is in the region of 5 to 15 per cent of the original piece of soap. When one calculates the amount of soap discarded by a single user in a year the amount wasted in terms of both cost and material can be significant. Also the impact of the wasted soap on the environment and drainage systems is another cause for concern.

To overcome this wastage it has been common practice for the user to simply mount the soap remnant on top of a new cake of soap so that after some use the two pieces of soap are moulded to become one. A problem with this practice has been the difficulty of getting the soap remnant to adhere to the new cake. Another disadvantage is that such a practice usually produces an unattractive and untidy result.

To overcome these problems, a number of inventions have been proposed, the majority of which involve the production of a cake of soap provided on one of its major surfaces with a recess shaped to receive a soap remnant. However a problem of getting the remnant soap to adhere readily to the new cake of soap remained a problem.

To obviate this problem there have been proposals to provide the recess with means to assist the retention of the soap remnant onto the new soap. One example provided for a plurality of shallow dimples on the recess to act as "suction cups" to hold the soap remnant in place. Another example provided raised notches on the recess to "spear" the soap remnant in position.

However the proposals somewhat complicates the manufacturing process of the new soap cake which could lead to an increase in costs eventually passed onto the consumer.

The present invention will seek to overcome or at least reduce the above identified problems or to provide the public with an alternative choice, by providing a cake of soap with means to receive and retain a used remnant of soap.

Thus in one form the invention resides in a cake of soap provided with a cavity which is adapted to receive a remnant of soap, said cavity extending into the interior region of said cake of soap wherein an opening to said cavity is provided on one side face of said cake of soap, said cavity having a pair of faces which are in opposed relation between which said remnant of soap is receivable.

It is preferable that the cavity be located along the longitudinal axis of the cake of soap. It is also preferable that the cavity be offset from the centre of the cake of soap.

The spacing between the opposed faces of the cavity is preferably less than the distance which the cavity extends inwardly from the opening. Preferably the opposed faces each extend transversely of the inward extent of the cavity and the spacing between the faces is less than the transverse extent of the faces.

Preferably the cavity is elongated and the opening opens into the longitudinal extent of the cavity.

Preferably the cavity is elongated and the opening opens into the transverse extent of the cavity.

In one arrangement an opening to the cavity is provided with the opening being located at one end face of the cake of soap. The cavity may be in the form of a pocket. In another arrangement two openings to the cavity may be provided each being located at opposing end faces of the cake of soap.

The off centre position ensures that when the soap remnant is inserted into the cavity and the new cake of soap used, the soap remnant will be totally or at least partly used as well. The size of the cavity should be such that the soap remnant is able to be inserted within the cavity so that a portion of the soap remnant protrudes therefrom.

The cavity is preferably located a sufficient distance away from the edges of the cake of soap so that the surrounding walls of the cavity are of sufficient strength so that the cake of soap can be handled without damage.

Preferably the cavity is dimensioned to receive a remnant of soap whilst it is still of a reasonable size and before it becomes too difficult to handle. Preferably the cavity is dimensioned to receive a remnant of soap which is about 5% to 15% of its original size.

It is also preferable that the cake of soap or soap remnant or both be moistened prior to insertion of the soap remnant into the cavity. Preferably when the soap remnant is inserted within the cavity a portion of the soap remnant protrudes. To lock the soap remnant within the cavity, force is applied to the protruding portion thereby forcing the soap remnant within the cavity and causing it to deform. This deformation preferably fills the mouth portion of the cavity thereby forming a plug which at least partly seals the opening.

One embodiment of the invention will now be described with reference to the accompanying drawings in which.

Figure 1:
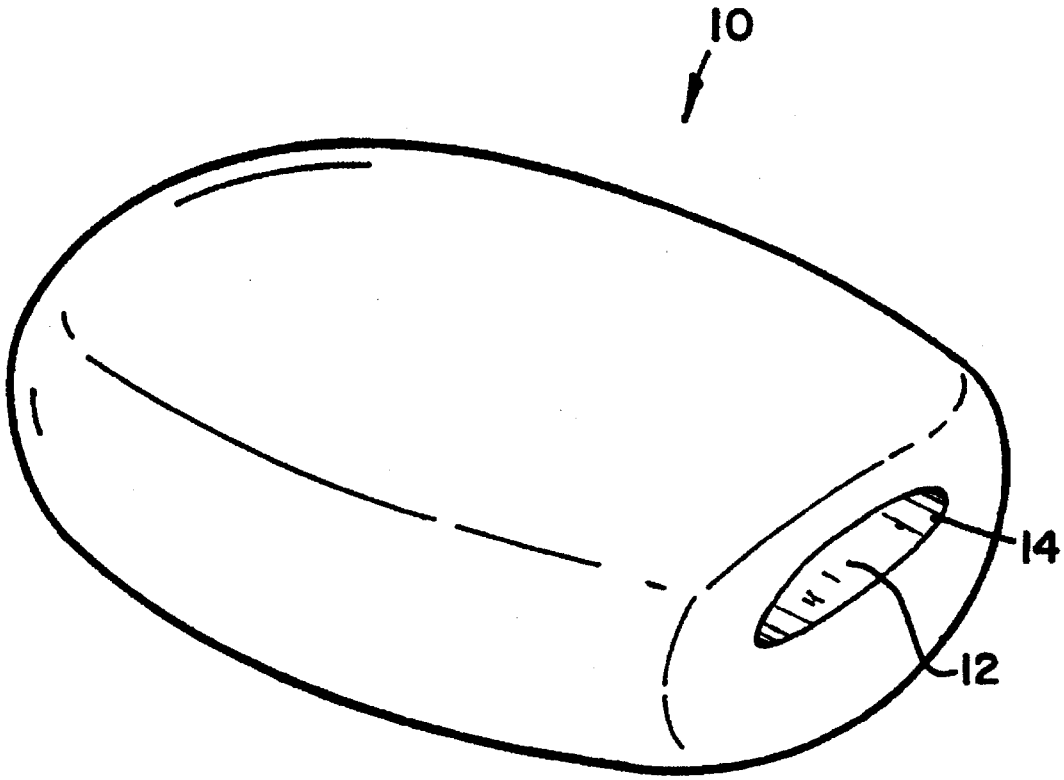
FIG. 1 is a perspective view of a cake of soap according to the embodiment.

As seen in the drawings the embodiment is directed to a cake of soap 10 which in this particular embodiment is of the typical tablet shape. It should be appreciated that the shape of the soap can be of any desired configuration.

Figure 2:
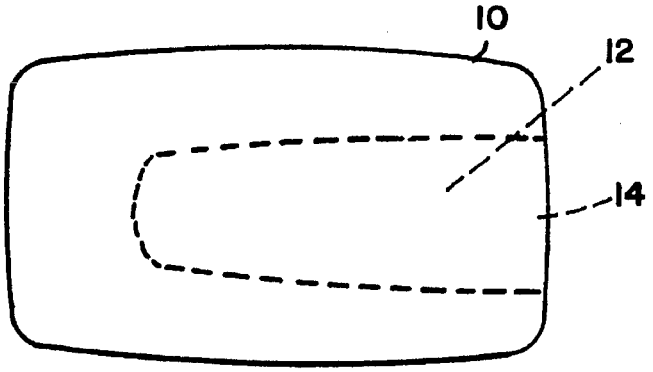
FIG. 2 is a plan view of the embodiment.
Figure 3:
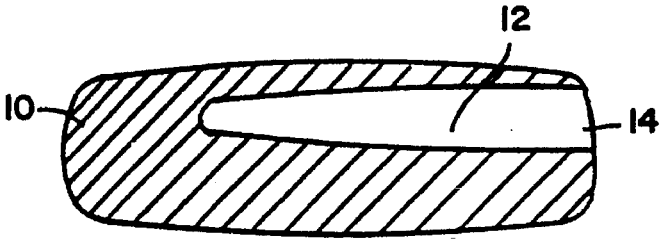
FIG. 3 is a side elevation view of the embodiment.

Located off centre within the cake of soap 10 is a cavity 12 in the form of a pocket which extends along the longitudinal axis of the cake of soap 10 and is preferably of a rectangular or oblong configuration to correspond generally to the shape of the used soap remnant. The cavity 12 extends more than half way through the longitudinal length of the cake of soap 10, the extent of which is best illustrated by FIGS. 2 and 3. The mouth 14 of the cavity 12 is located at one end of the cake of soap 10.

The reason for having the cavity 12 located off centre within the cake of soap 10 is to ensure that the soap remnant is entirely or at least partly used when the new cake of soap is worn through use. If the cavity were to be centrally located, the soap remnant will always be left when the new soap cake is worn.

The cavity 12 is positioned a sufficient distance away from the longitudinal edges of the soap cake 10 to ensure that the wall surrounding the cavity 12 are of sufficient strength so that the cake of soap can be handled without damage to the cavity walls.

The cavity 12 may be made by punching out, moulding or by any other suitable technique.

Figure 4:
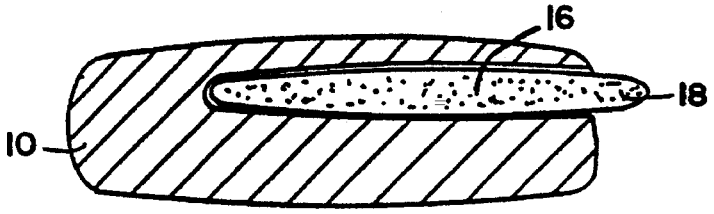
FIG. 4 is a side elevation view of the embodiment with a soap remnant inserted within the cavity.
Figure 5:
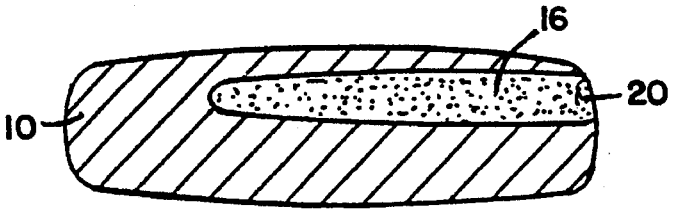
FIG. 5 is a side elevation view of the embodiment with a soap remnant locked within the cavity.

In use, a cake of soap is worn down to a reasonable size preferably before it becomes too difficult to grasp or before it becomes too soft and tacky and forms the soap remnant 16. This is usually when the cake is worn down to about 5 to 15 per cent of its original size. Next a cake of soap 10 is then moistened so that the walls of the cavity 12 are sufficiently wet or the soap remnant 16 moistened or both. This is done in order to assist the adherence of the two pieces of soap to each other. The soap remnant 16 is then longitudinally inserted into the cavity 12. As shown at FIG. 4 when inserted, a portion 18 of the soap remnant 16 protrudes from the cavity.

To lock the soap remnant 16 in place force is applied to the protruding portion 18 thereby forcing the soap remnant 16 within the cavity 12 and causing it to deform. This deformation fills the mouth portion of the cavity thereby forming a plug 20 which effectively seals cavity 12 so that the soap remnant does not become dislodged during use.

It should be appreciated that various other changes and modifications may be made to the embodiment described without departing from the spirit and scope of the invention.

I claim:

1. A cake of soap having an exterior side face and a cavity which is adapted to receive a remnant of soap, said cavity having peripheral wall means extending into the interior region of said cake of soap away from said exterior side face, and opening to said cavity being provided on said exterior side face of said cake of soap, said opening being bounded by said peripheral wall means said opening being sized to be substantially the same as the cavity said peripheral wall means having a pair of faces which are in opposed relation between which said remnant of soap is retained, whereby the inward extent of said cavity is greater than the spacing between said pair of wall faces wherein said cavity is spaced from the edges of said cake of soap so that the walls defining said cavity are of sufficient strength and do not readily collapse when handled, and wherein said cavity is offset from the centre of said cake of soap.

2. A cake of soap as claimed in claim 1 wherein said cavity is located along the longitudinal axis of said cake of soap.

3. A cake of soap as claimed in claim 1 wherein said pair of faces each extend transversely of the inward extent of said cavity.

4. A cake of soap as claimed in claim 1 wherein said pair of faces extend in the direction of the inward extent of said cavity.

5. A cake of soap as claimed in claim 1 wherein the cavity is elongated and said opening opens into the longitudinal extent of said cavity.

6. A cake of soap as claimed in claim 1 wherein the cavity is elongated and said opening opens into the transverse extent of said cavity.

7. A cake of soap as claimed in claim 1 wherein two openings to said cavity are provided at opposing faces of said cake of soap.

8. A cake of soap as claimed in claim 1 wherein said cavity is spaced from the edges of said cake of soap so that the walls defining said cavity are of sufficient strength and do not readily collapse when handled.

9. A cake of soap as claimed in claim 1 wherein said cavity is dimensioned to receive a remnant of soap whilst it is still of a reasonable size and before it becomes difficult to handle.

10. A cake of soap as claimed in claim 9 wherein said cavity is dimensioned to receive a remnant of soap which is about 5% to 15% of its original size.

11. A cake of soap as claimed in claim 1 wherein said cake of soap and/or remnant of soap is adapted to be moistened prior to the insertion of said remnant of soap into said cavity.

12. A cake of soap as claimed in claim 1 wherein said remnant of soap is lockable within said cavity by the application of force during insertion thereby deforming said remnant of soap and causing it to form a plug which at least partly seals said opening.

13. A cake of soap having an exterior side face and a cavity which is adapted to receive a remnant of soap, said cavity having peripheral wall means extending into the interior region of said cake of soap away from said exterior side face an opening to said cavity being provided on said exterior side face of said cake of soap, said cavity having a pair of faces which are in opposed relation between which said remnant of soap is retained and wherein said pair of faces each extend transversely of the inward extent of said cavity, whereby the inward extent of said cavity is greater than the spacing between said pair of faces, and wherein said cavity is located along the longitudinal axis of said cake of soap and said cavity tapers inwardly along the inward extent thereof and wherein said cavity is spaced from the edges of said cake of soap so that the walls defining said cavity are of sufficient strength and do not readily collapse when handled, and wherein said cavity is offset from the centre of said cake of soap and wherein said cavity is dimensioned to receive a remnant of soap while it is still of a reasonable size and before it becomes difficult to handle.

14. A cake of soap as recited in claim 13, wherein said remnant of soap is lockable within said cavity by the application of force during insertion thereby deforming said remnant of soap and causing it to form a plug which at least partly seals said opening.

15. A cake of soap as recited in claim 14, wherein said pair of faces each extend transversely of the inward extent of said cavity.

16. A cake of soap as recited in claim 15, wherein said pair of faces extend in the direction of the inward extent of said cavity.

17. A cake of soap as recited in claim 16, wherein the cavity is elongated and said opening opens into the longitudinal extent of said cavity.

18. A cake of soap as recited in claim 17, wherein the cavity is elongated and said opening opens into the transverse extent of said cavity.

19. A cake of soap as recited in claim 13, wherein two openings to said cavity are provided at opposing faces of said cake of soap.

20. A cake of soap as recited in claim 19, wherein said cavity is spaced from the edges of said cake of soap so that the walls defining said cavity are of sufficient strength and do not readily collapse when handled.

21. A cake of soap as recited in claim 20, wherein said cavity is dimensioned to receive a remnant of soap whilst it is still of a reasonable size and before it becomes difficult to handle.

22. A cake of soap as recited in claim 21, wherein said cavity is dimensioned to receive a remnant of soap which is about 5% to 15% of its original size.

23. A cake of soap as recited in claim 22, wherein said cake of soap and/or remnant of soap is adapted to be moistened prior to the insertion of said remnant of soap into said cavity.

24. A cake of soap as recited in claim 23, wherein said remnant of soap is lockable within said cavity by the application of force during insertion thereby deforming said remnant of soap and causing it to form a plug which at least partly seals said opening.

* * * * *